US006940402B1

(12) United States Patent
Lewis et al.

(10) Patent No.: US 6,940,402 B1
(45) Date of Patent: Sep. 6, 2005

(54) METHOD AND APPARATUS FOR DETECTION OF A LOCATION OF AN EVENT

(76) Inventors: Clive Martin Lewis, 125 Fairview Road, Stevenage, Hertfordshire (GB) SG1 2NP; Mark Philip Symonds, 20 Greensand Ridge, Lidlington, Bedfordshire (GB) MK43 0PB ( * ) Notice: Subject to any disclaimer, the term of this patent is extended or adjusted under 35 U.S.C. 154(b) by 0 days.

(21) Appl. No.: 09/979,697

(22) PCT Filed: May 8, 2000

(86) PCT No.: PCT/GB00/01622

§ 371 (c)(1),
(2), (4) Date: Nov. 6, 2001

(87) PCT Pub. No.: WO00/68909

PCT Pub. Date: Nov. 16, 2000

(30) Foreign Application Priority Data

May 8, 1999 (GB) ..... 9910540

(51) Int. Cl.[7] ..... G08B 5/00; G08B 25/00; G08B 26/00; G08B 17/10

(52) U.S. Cl. ..... 340/531; 340/518; 340/524; 340/286.05; 340/286.06; 340/286.07; 340/628; 340/629; 340/630; 340/631; 340/632

(58) Field of Search ..... 340/627, 628–634, 340/518, 524, 286.01, 286.05, 286.07, 286.08; 341/22, 25, 31

(56) References Cited

U.S. PATENT DOCUMENTS

| | | | | |
|---|---|---|---|---|
| 3,576,569 | A * | 4/1971 | Watson | 341/25 |
| 3,627,936 | A * | 12/1971 | Cullen | 200/5 E |
| 3,678,487 | A * | 7/1972 | Ludewig et al. | 340/507 |
| 3,765,842 | A * | 10/1973 | Purt | 436/55 |
| 3,873,978 | A * | 3/1975 | Niki | 341/22 |
| 3,952,808 | A * | 4/1976 | Richardson | 169/61 |
| 4,318,087 | A * | 3/1982 | Wilson | 341/26 |
| 4,764,758 | A * | 8/1988 | Skala | 340/627 |
| 4,980,685 | A * | 12/1990 | Souloumiac et al. | 341/31 |
| 5,552,775 | A * | 9/1996 | Harley | 340/628 |

* cited by examiner

*Primary Examiner*—Brent A. Swarthout
*Assistant Examiner*—Lam Pham
(74) *Attorney, Agent, or Firm*—The Weintraub Group, PLC

(57) ABSTRACT

A method and apparatus for detecting the location of an event from amongst a plurality (A to P) of locations. Lines of communication (R1 to R4, C1 to C4), commonly pipes of a smoke detection system, cover the locations in such a fashion that the location of an event can be determined uniquely but the number of pipes is minimized.

12 Claims, 2 Drawing Sheets

METHOD AND APPARATUS FOR DETECTION OF A LOCATION OF AN EVENT

BACKGROUND OF THE INVENTION

1. Field of the Invention

This invention relates to a method of and apparatus for detecting the location of an event, in particular the presence of an impurity in a gaseous medium.

2. Description of the Prior Art

It is known, when a plurality of locations need to be protected against fire, to provide at each location a detector to detect smoke in the air. Each detector detects any smoke generated by a fire at the location which it protects. The disadvantage of this arrangement is that if, for example, sixteen rooms or machines need protecting against fire, then sixteen detectors are required, with the high cost that this entails.

Aspirating systems for detecting smoke or explosive or poisonous gas in air are known which enable the detectors to be remote from the locations to be protected. In such a known aspirating system, an air sampling smoke or gas detector monitors from several points along the length of a pipe, but is unable to distinguish between inlets to the pipe, so that, if a smoke or gas signal is generated by such a detector, then the particular location along its pipe must still be found. If unambiguous identification of the smoke or gas source is required, an air sampling pipe is taken to each possible source location. The sampled air is taken either to a dedicated detector or to a scanning valve arrangement, so that the pipe carrying the smoke or gas can be identified, and hence the source located; however, both the system with the dedicated detectors and the system with the scanning valve arrangement are relatively expensive. The scanning valve arrangement is a multiplexing arrangement. In some versions of this arrangement the pipe outlets enter a common chamber containing or communicating with a single detector and either a series of flap valves are provided at the respective outlets, or a rotary valve plate formed with a single port is provided at the outlets, as disclosed in, for example, GB-A-2243475. In another version disclosed in, for example, U.S. Pat. No. 3,765,842 the sampling pipes extend through respective controlled valves to a common duct leading to a pump downstream of which is the single detector. In all versions the sampling pipes remain continuously open until smoke or gas is sensed by the detector when all except one pipe are closed in turn until the pipe carrying the smoke or gas is identified.

BRIEF SUMMARY OF THE INVENTION

According to a first aspect of the present invention, there is provided a method of determining at which of a plurality of locations an event is occurring, comprising providing a plurality of lines of communication communicating with and dedicated to the locations of respective groups of said locations, wherein each line of communication serves at least one location which is served by another of the lines of communication, and wherein the occurrence of an event at any one of the locations along any one of the lines of communication is detected in a manner which distinguishes between occurrences of the event along one of the lines of communication and occurrences of the event along any other of the lines of communication.

According to a second aspect of the present invention, there is provided apparatus for determining at which of a plurality of locations an event is occurring, comprising a plurality of lines of communication which are arranged to communicate with and be dedicated to the locations of respective groups of said locations, each line of communication being arranged to serve at least one location which is served by another of the lines of communication, and detecting means arranged to detect the occurrence of an event at any one of the locations along any one of the lines of communication in a manner which distinguishes between occurrence of the event along one of the lines of communication and occurrence of the event along any other of the lines of communication.

Owing to these aspects of the invention, it is possible to reduce greatly the amount of detecting means required to cover a given plurality of locations. Merely by way of example, if there are sixteen locations to be protected, then the minimum amount of detecting means could be obtained by using one series of four detectors (or a scanning valve arrangement with a single detector and four scanned outlets) and another series of three detectors (or a scanning valve arrangement with a single detector and three scanned outlets). An even greater economic advantage can be obtained with fifteen locations, where a minimum of two series each of three detectors (or two scanning valve arrangements each with three scanned outlets) can be employed.

Advantageously no one location is served by the same two lines of communication as any other location. Alternatively this could apply to a majority of the locations.

The event in question could be occurrence of a particular characteristic of a gaseous medium, e.g. the presence of an impurity, for example smoke or chlorine gas, in the gaseous medium at one of the locations, and in those circumstances the lines of communication could be sampling pipes of an aspirating system for the gaseous medium.

BRIEF DESCRIPTION OF THE DRAWINGS

In order that the invention may be clearly understood and readily carried into effect, reference will now be made, by way of example, to the accompanying drawings, in which.

DETAILED DESCRIPTION OF THE INVENTION

Figure 1:
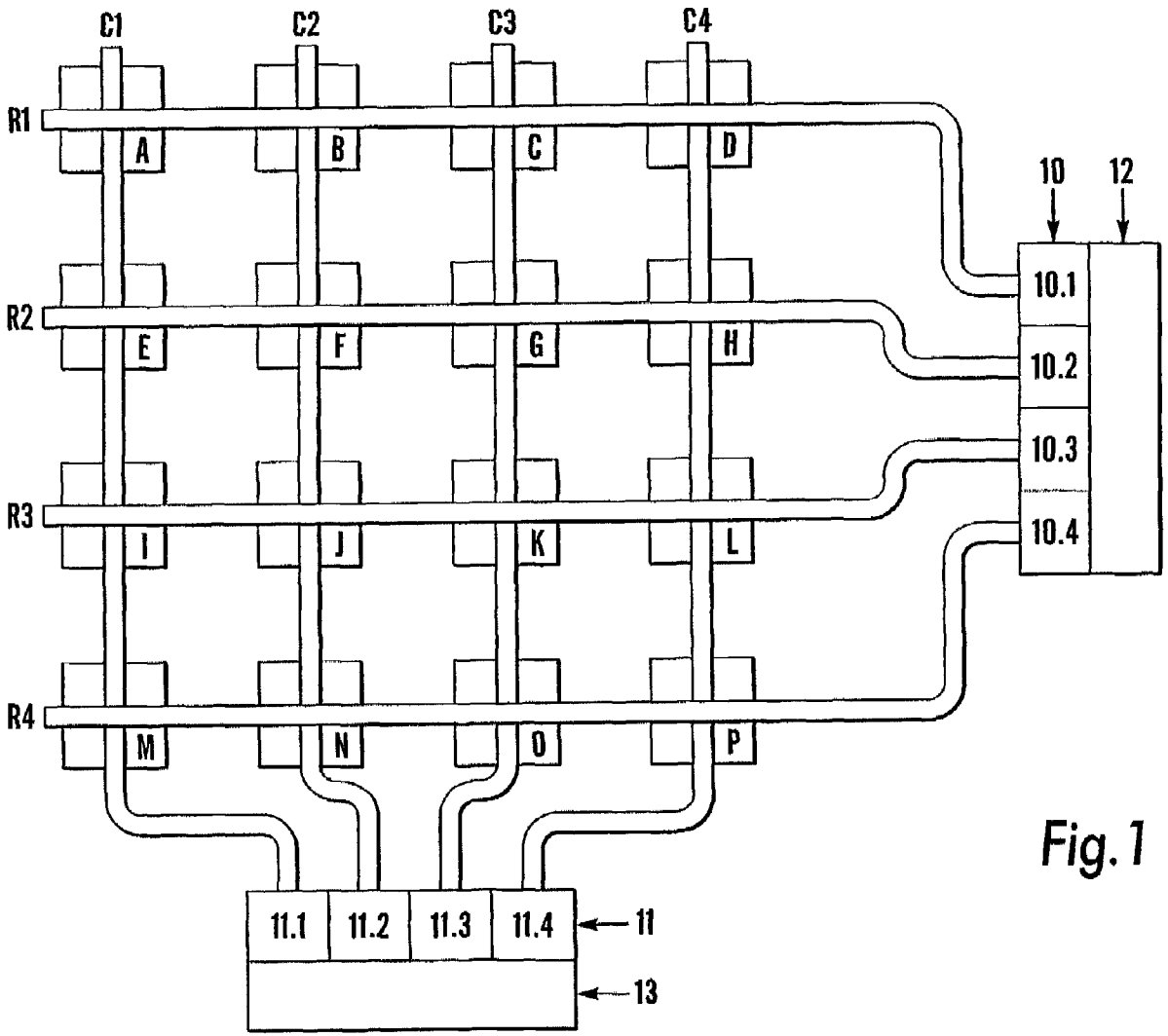
FIG. 1 is a schematic plan view of a plurality of cabinets protected by an aspirating smoke detection system including eight smoke detectors.

Referring to FIG. 1, the sixteen cabinets A to P each have the air inside them monitored by way of two different sampling pipes, one from the row pipes R1 to R4 and one from the column pipes C1 to C4. Each row pipe and each column pipe receives, via sampling connections (not shown), samples of the air in four cabinets and each pipe is connected to a single detector contained in one of two series of detectors 10 (i.e. 10.1; 10.2; 10.3 and 10.4) and 11 (i.e. 11.1; 11.2; 11.3 and 11.4). By comparing the readings at the two series of detectors 10 and 11, the location at which smoke has been detected can be immediately determined. For example, if smoke is detected in pipe R3 (by detector 10.3) and pipe C2 (by detector 11.2), the smoke source must be cabinet J. The detectors could be connected to computing means (not shown) that will process the signals received from the detectors and thereby automatically determine the location of the smoke. An appropriate alarm signal will then be produced.

The pipes R1 to R4 have downstream of their respective detectors 10.1 to 10.4 a common fan 12 and the pipes C1 to C4 have downstream of their respective detectors 11.1 to 11.4 a common fan 13 and these fans continually draw the air from the cabinets through the sampling pipes and the detectors. The processing of detection information received is known and is described in, for example, WO95/04338.

In an unillustrated version, the detectors 10.1 to 10.4 and 11.1 to 11.4 have respective dedicated fans upstream or downstream thereof. In a further unillustrated version a single detector 10 or 11 with a single fan 12 or 13 upstream or downstream thereof has its pipes R or C connected thereto via a scanning valve arrangement.

The system, in which each location has two sampling connections, is applicable to numbers smaller or larger than sixteen locations, but the advantage of a reduction in the number of detectors required compared with one detector for each location arises only if there are at least six locations.

Figure 2:
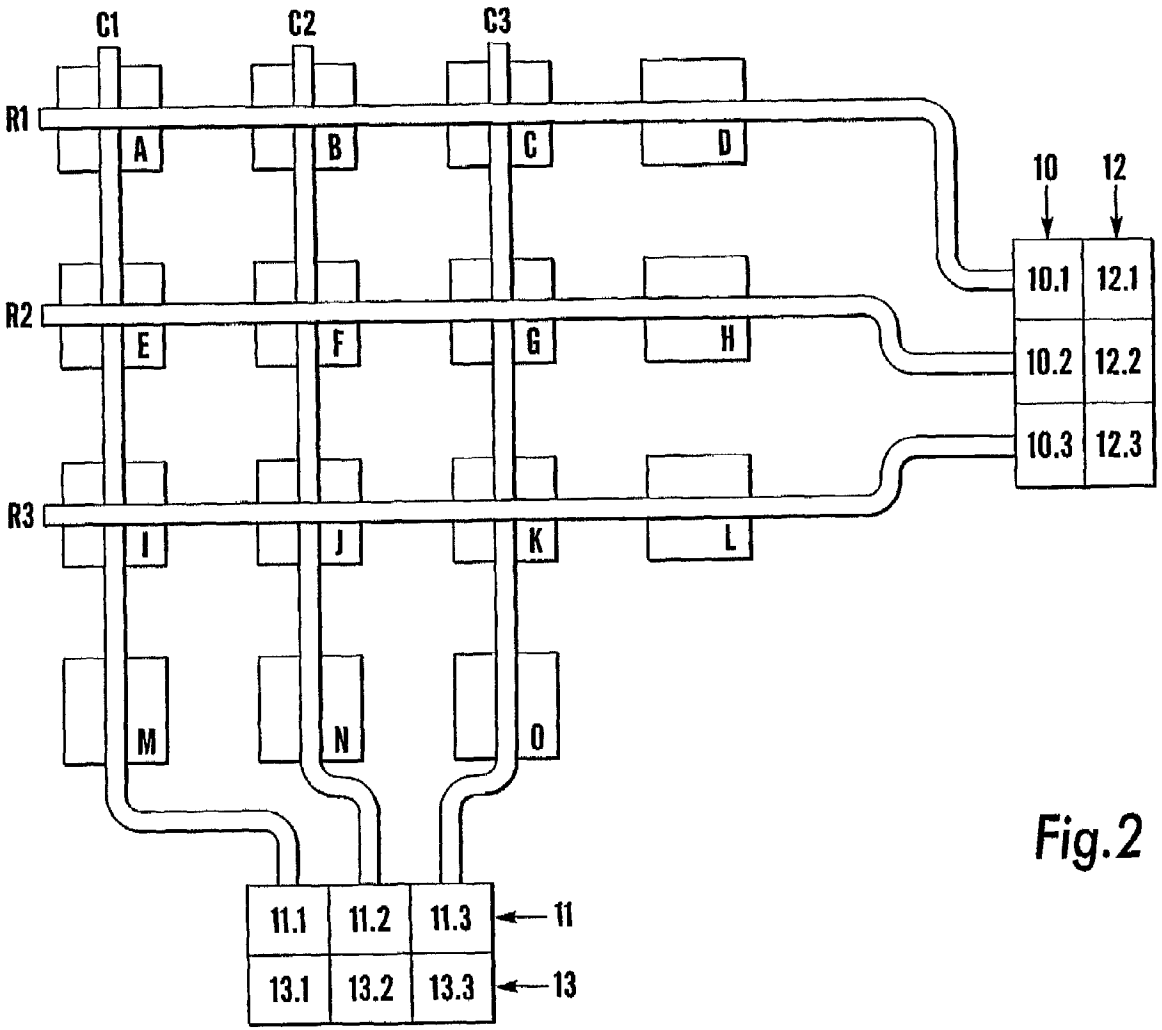
FIG. 2 is a view similar to FIG. 1 of a modified version.

To reduce the initial cost of the system it is possible to omit one row pipe, one column pipe, or one of each, the latter possibility being illustrated by the version shown in FIG. 2, which differs from that shown in FIG. 1 chiefly in that the pipes R4 and C4 and their corresponding detectors 10.4 and 11.4 have been omitted, which necessitates omission of location P for detection purposes. Another difference is that the detectors are shown as having dedicated fans 12.1 to 12.3 and 13.1 to 13.3, although of course, a common fan 12 or 13 could be provided or, again, there could be single detectors 10 and 11 with respective scanning valve arrangements. Thus one row and one column of locations are not covered by two pipes and yet detection is still specific for each of the fifteen locations A to O. For example, smoke detected from pipe C2 but not detected from any of the row pipes would indicate the presence of smoke at location N.

Again, this version is applicable to numbers of locations smaller or larger than fifteen, and the advantage of a reduction in the number of detectors required compared with one detector for each location arises if there are at least three locations.

It is not necessary for the locations to be protected to be physically arranged in rows and columns, as the pipes can be arranged to suit virtually any physical layout of the locations. Moreover, the members of each series of pipes, detectors and fans can be arranged in any desired physical relationship to each other.

The arrangement of locations shown in FIG. 1 or 2 can be considered as a mathematical array.

The maximum number of an array of locations to be protected is determined by the maximum number of sampling holes feasible on each sampling pipe. In a case where the maximum legally permitted is 25 holes per pipe, this means that theoretically 625 cabinets could be monitored using 13 series of four detectors each. Using the currently known technique, 157 series of four detectors each would be required. If more locations need to be monitored, multiple arrays can be implemented.

It is also possible to use arrays in more than two dimensions. If a three-dimensional array were to be used, 64 locations could be monitored using 12 detectors (four rows, four columns and four stories).

The system is applicable to any situation where a plurality of different locations is required to be protected. For example, rather than enclosures such as cabinets, the detectors could be protecting individual rooms.

We claim:

1. A method of determining at which of a plurality of locations an event is occurring, comprising providing a plurality of lines of communication, communicating with and dedicated to the locations of respective groups of said locations, wherein each line of communication serves at least one location which is served by another of the lines of communication, wherein the occurrence of an event at any one of the locations along any one of the lines of communication is detected in a manner which distinguishes between occurrences of the event along one of the lines of communication and occurrences of the event along any other of the lines of communication, wherein said event is the presence of smoke or an undesired gas concentration, and wherein atmospheres at the respective locations are sampled by way of sampling pipes providing the respective lines of communication.

2. A method according to claim 1, wherein no one location of a majority of said locations id served by the same two lines of communication as any other location.

3. A method according to claim 1, wherein no one location of substantially all of said locations is served by the same two lines of communication as any other location.

4. A method according to claim 1, wherein at least one location is served by only one line of communication.

5. A method according to claim 1, wherein the location of an event is determined by using signals received from two of said lines of communication.

6. Apparatus for determining at which of a plurality of locations an event is occurring, comprising a plurality of lines of communication which are arranged to communicate with and be dedicated to the locations of respective groups of said locations, each line of communication being arranged to serve at least one location which is served by another of the lines of communication, and a detecting arrangement serving to detect the occurrence of an event at any one of the locations along any one of the lines of communication in a manner which distinguishes between occurrences of the event along one of the lines of communication and occurrence of the event along any other of the lines of communication, wherein said lines of communication are sampling pines, and said detecting arrangement detects the presence of smoke or an undesired gas concentration.

7. Apparatus according to claim 6, wherein no one location of a majority of said locations is served by the same two lines of communication as any other location.

8. Apparatus according to claim 7, wherein no one location of substantially all of said locations is served by the same two lines of communication as any other location.

9. Apparatus according to claim 6, wherein at least one location is served by only one line of communication.

10. Apparatus according to claim 6, wherein said detecting arrangement comprises a plurality of detectors, each detector corresponding to a line of communication.

11. Apparatus according to claim 6, and further comprising a fan arrangement for drawing air through said sampling pipes to said detecting arrangement.

12. Apparatus according to claim 6, and further comprising a computing device communicating with said detecting arrangement for determining the location of an event by using signals received from two of said lines of communication.

* * * * *

UNITED STATES PATENT AND TRADEMARK OFFICE

CERTIFICATE OF CORRECTION

PATENT NO. : 6,940,402 B1
APPLICATION NO. : 09/979697
DATED : September 6, 2005
INVENTOR(S) : Clive Martin Lewis and Mark Philip Symonds It is certified that error appears in the above-identified patent and that said Letters Patent is hereby corrected as shown below:

On the title page Add item (73),

Assignee: Airsense Technology Limited

Signed and Sealed this

Third Day of June, 2008

JON W. DUDAS
*Director of the United States Patent and Trademark Office*